US012071274B2

(12) United States Patent
Aneck-Hahn et al.

(10) Patent No.: US 12,071,274 B2
(45) Date of Patent: Aug. 27, 2024

(54) MODULAR PRODUCE CRATE

(71) Applicants: Richard Aneck-Hahn, Johannesburg (ZA); Krzysztof Blaski, Tweed heads (AU)

(72) Inventors: Richard Aneck-Hahn, Johannesburg (ZA); Krzysztof Blaski, Tweed heads (AU)

( * ) Notice: Subject to any disclaimer, the term of this patent is extended or adjusted under 35 U.S.C. 154(b) by 227 days.

(21) Appl. No.: 17/754,698

(22) PCT Filed: Oct. 15, 2020

(86) PCT No.: PCT/AU2020/051106
§ 371 (c)(1),
(2) Date: Apr. 8, 2022

(87) PCT Pub. No.: WO2021/072492
PCT Pub. Date: Apr. 22, 2021

(65) Prior Publication Data

US 2023/0052384 A1 Feb. 16, 2023

(30) Foreign Application Priority Data

Oct. 15, 2019 (AU) ..... 2019903879

(51) Int. Cl.
*B65D 19/18* (2006.01)
*B65D 85/34* (2006.01)

(52) U.S. Cl.
CPC ..... *B65D 19/18* (2013.01); *B65D 85/34* (2013.01); *B65D 2519/00034* (2013.01);
(Continued)

(58) Field of Classification Search
CPC .... B65D 2519/567; B65D 2519/00666; B65D 2519/00323
(Continued)

(56) References Cited

U.S. PATENT DOCUMENTS 3,985,258 A * 10/1976 Quigley ..... B65D 11/1873 217/43 A
4,000,827 A * 1/1977 Emery ..... B65D 11/1873 217/43 A
(Continued)

FOREIGN PATENT DOCUMENTS

EP 0286271 A2 10/1988
EP 1264774 A1 12/2002
(Continued)

OTHER PUBLICATIONS

European Search Report dated Sep. 19, 2023 from counterpart Europe Application No. 20875673.4.
(Continued)

*Primary Examiner* — Ernesto A Grano
*Assistant Examiner* — Symren K Sanghera
(74) *Attorney, Agent, or Firm* — INNOVATION CAPITAL LAW GROUP, LLP; Vic Lin

(57) ABSTRACT

A modular produce crate has four side panels, a base panel and abase having a quadrant of upper surface corner base connectors. Each side panel defines an interior base panel channel, a pair of side panel corner connectors extending below the channel and side panel interfacing edges above the channel. Adjacent pairs of the side panel corner connectors plug into each respective corner base connector to enclose the channels around the base panel to hold the base panel and adjacent interfacing edges thereof are fastened together. As such, the base panel is held fast by the engagement of the side panel connectors within the respective base connectors thereunderneath and by the fastened interfacing edges of the side panels thereabove.

27 Claims, 8 Drawing Sheets

(52) U.S. Cl.
CPC ..... *B65D 2519/00069* (2013.01); *B65D 2519/00134* (2013.01); *B65D 2519/00174* (2013.01); *B65D 2519/00273* (2013.01); *B65D 2519/00288* (2013.01); *B65D 2519/00308* (2013.01); *B65D 2519/00323* (2013.01); *B65D 2519/00333* (2013.01); *B65D 2519/00412* (2013.01); *B65D 2519/00497* (2013.01); *B65D 2519/00522* (2013.01); *B65D 2519/00567* (2013.01); *B65D 2519/00572* (2013.01); *B65D 2519/00587* (2013.01); *B65D 2519/00621* (2013.01); *B65D 2519/00796* (2013.01); *B65D 2519/00975* (2013.01)

(58) Field of Classification Search
USPC ..... 206/598
See application file for complete search history.

(56) References Cited

U.S. PATENT DOCUMENTS 5,638,973 A * 6/1997 Dewey ..... B65D 11/1873 206/509
5,722,551 A * 3/1998 Cocciemiglio, Jr. .... B65D 9/24 220/4.33
6,216,899 B1 * 4/2001 Vicari ..... B65D 19/16 206/600
6,752,285 B1 * 6/2004 Scalf ..... B65D 11/1873 220/4.32
11,286,106 B1 * 3/2022 Meeks ..... B65D 15/24
2014/0197168 A1 * 7/2014 Miller ..... B65D 21/0215 220/4.33

FOREIGN PATENT DOCUMENTS

EP 1516823 A1 3/2005
EP 2036826 A2 3/2009
JP 2018012516 A 1/2018
WO 2011092652 A2 8/2011

OTHER PUBLICATIONS

International Preliminary Report on Patentability (Chapter II) dated Apr. 8, 2021 from PCT Application No. PCT/AU2020/051106.
International Search Report & Written Opinion dated Dec. 8, 2020 from corresponding PCT Application No. PCT/AU2020/051106.
International-type search dated Jan. 16, 2020 for Australian Application No. 2019903879.

* cited by examiner

MODULAR PRODUCE CRATE

FIELD OF THE INVENTION

This invention relates generally to a modular produce crate, such as for agricultural produce including apples.

BACKGROUND OF THE INVENTION

Modular crate construction is desirous including to reduce complication and expense of integrally formed plastic injection techniques.

Various modular crate configurations exist including U.S. Pat. No. 5,722,551 A (COCCIEMIGLIO, JR) 3 Mar. 1998 disclosing a particular type of panel connecting clip for joining adjacent approved panels, U.S. Pat. No. 3,985,258 A (QUIGLEY et al) 12 Oct. 1976 disclosing a knock-down produce container consisting of four identical sides and a bottom, EP 0286271 A2 (WORLD CONTAINER CORPORATION) 12 Oct. 1988 disclosing a collapsible container including a base and upstanding sides, EP 1264774 A1 (MODULARBOX OY) 11 Dec. 2002 disclosing a pallet cage having a pallet and four walls mounted on its edges and U.S. Pat. No. 5,638,973 A (DEWEY et al) 17 Jun. 1997 disclosing a collapsible agricultural storage container having a base panel and a plurality of side panels removably connected to the base panel and interlocked at their edges by elongated, removable corner members.

The present invention seeks to provide a modular produce crate which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a modular produce crate comprising four side panels, base panel and base. The base has a quadrant of upper surface corner base connectors.

Each side panel defines an interior base panel channel, a pair of side panel corner connectors extending below the channel and side panel interfacing edges above the channel.

Unlike prior art arrangements which may involving corner channels which engage panels therebetween (such as is disclosed by COCCIEMIGLIO, JR), or which may involve four side panels which engage a rectangular base (such as the arrangements disclosed by QUIGLEY et al, WORLD CONTAINER CORPORATION and MODULARBOX OY and DEWEY et al), the present modular crate is assembled by enclosing the base panel within collocating channels of the four side panels arranged thereabout and pressing the side panels down together onto the base to plug the side panel connectors into the respective quadrant of base connectors thereof.

The base panel is held fast by the engagement of the side panel connectors within the respective base connectors thereunderneath and by the fastened interfacing edges of the side panels thereabove.

The base connectors may comprise an arrangement of location tabs, deflecting clips, buttresses and the like for secure engagement of the side panels and, in embodiments, the base panel.

The base preferably comprises a pair of elongate skids simplifying the construction and assembly of the crate.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
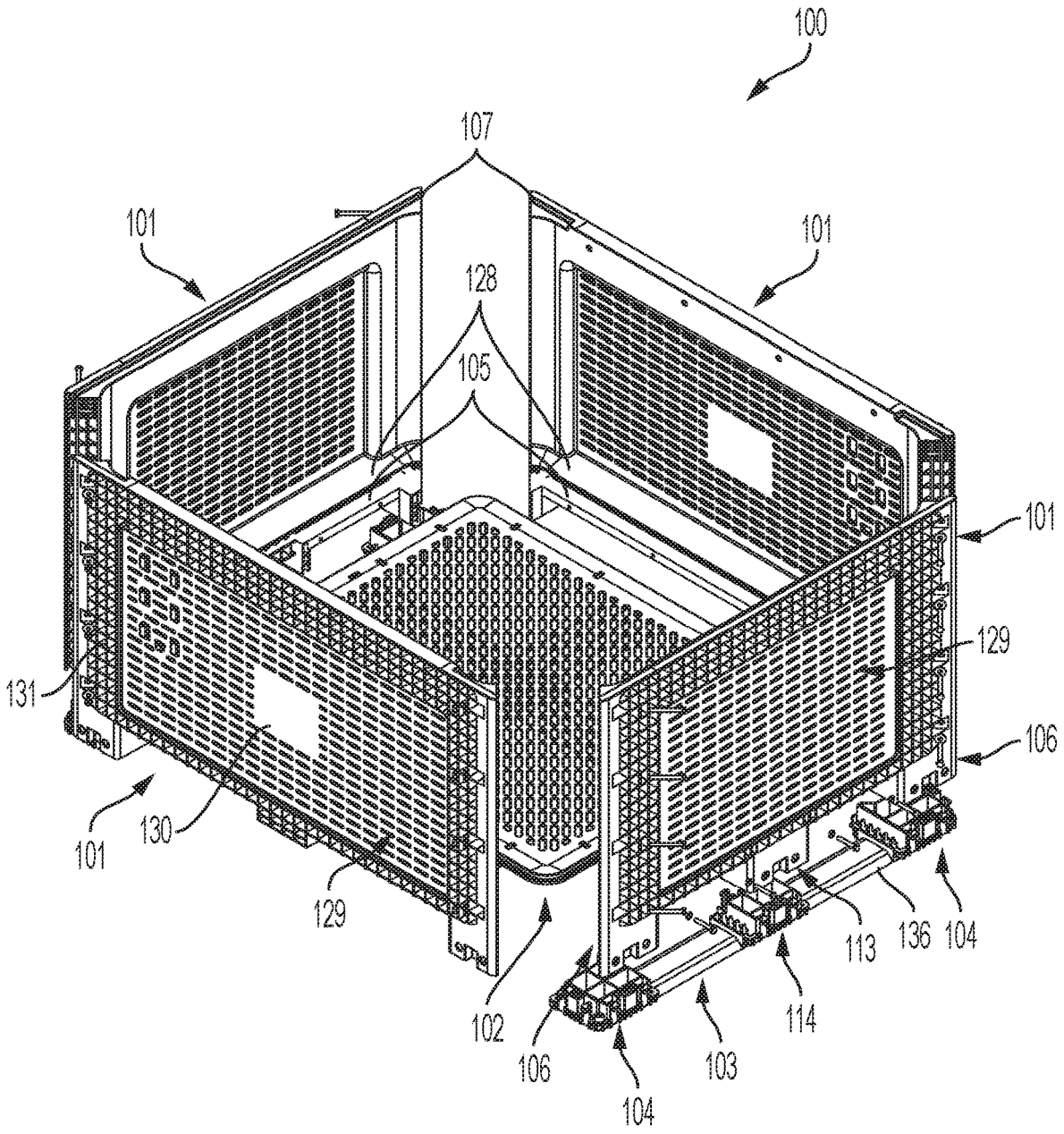
FIG. 1 shows a top perspective disassembled view of a modular produce crate in accordance with an embodiment.

A modular produce crate 100 comprises four side panels 101, a base panel 102 and a base which may comprise a pair of elongate skids 103, all of which may be made of injection moulded plastic. The base defines a quadrant of corner base connectors 104. Each skid 103 may have a pair of upper surface corner base connectors 104 at opposite ends thereof and a beam 136 spanning therebetween.

Each side panel 101 defines an interior base panel channel 105 and a pair of side panel corner connector 106 at opposite side edges thereof and extending beneath the channel 105. Each side panel 101 further defines interfacing edges 107 above the channel 105.

For assembly, pairs of adjacent side panel corner connectors 106 plug into respective corner base connectors 104 to enclose the channels 105 around the base panel 102 to hold the base panel 102 in place between the side panels 101. The adjacent interfacing edges 107 fasten together.

In the embodiment shown, the channel 105 is continuous and engages a corresponding respective continuous straight edge of the base panel 102 therein. However, in alternative less preferred embodiments, the channel 105 could be formed by a plurality of mortises engaging edge tenons of the base panel 102 or other similar interlocking arrangement.

Figure 4:
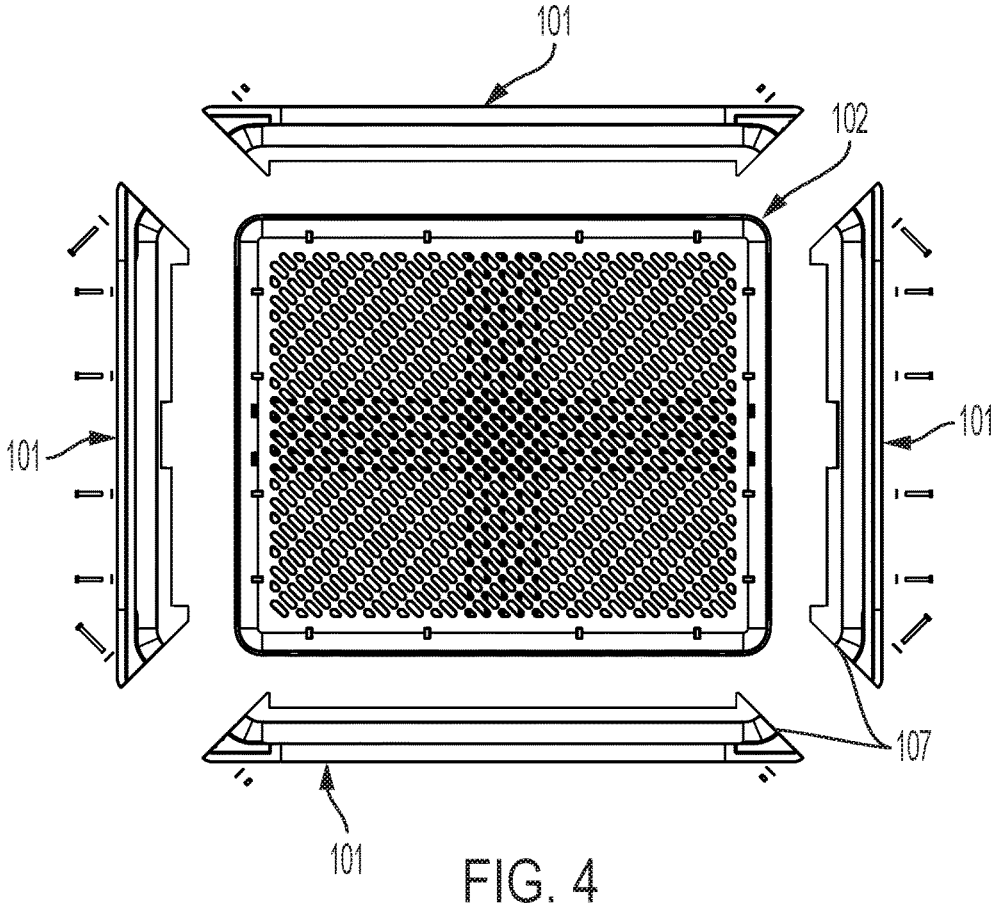
FIG. 4 shows a top plan disassembled view of the crate.

As best shown in FIG. 4, the interfacing edges 107 may be planar and may meet at 45° with respect to the horizontal plane orthogonal axes.

Figure 2:
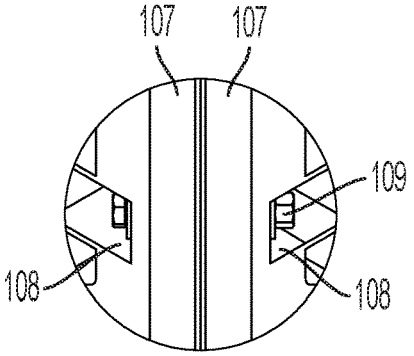
FIG. 2 shows a magnified view of interfacing edges of side panels of the crate in accordance with an embodiment.

As best shown in FIG. 2, the side panels 101 may define outer recesses 108 defining inner parallel planar pieces secured together by a fastener 109 extending therethrough.

Figure 3:
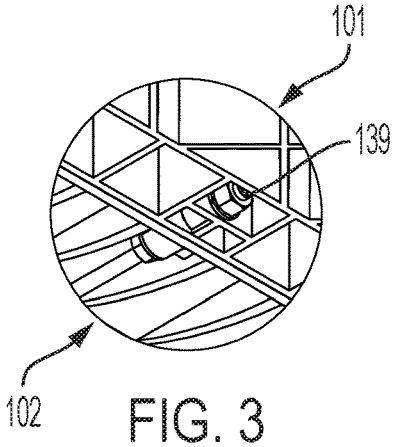
FIG. 3 shows an undersurface perspective view illustrating fastening of lower edges of a side panel to a base panel of the crate in accordance with an embodiment.

FIG. 3 shows wherein additional fasteners 139 secure lower edges of the side panels 101 and the base panel 102. As illustrated in FIG. 4, the base panel 102 may be generally rectangular and, as is further shown in FIG. 5, the additional fasteners 139 may run along long edges thereof.

Figure 16:
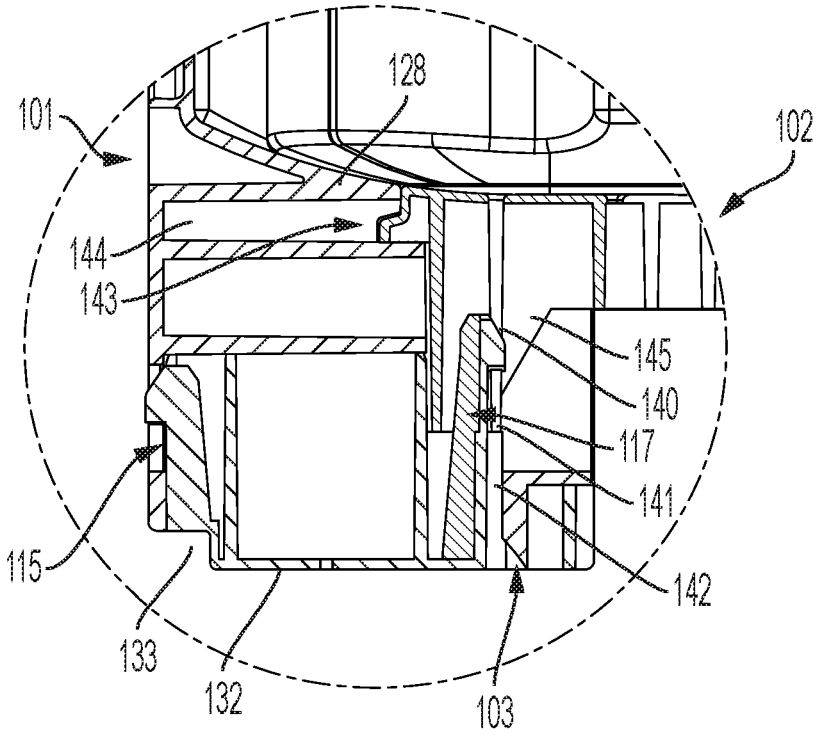
FIG. 16 shows an elevation cross-sectional magnified view of the crate.

Each side panel 101 may comprise an inwardly extending upper curved transition 128 which interfaces over or against a corresponding edge of the base panel 102. As shown in FIG. 16, an upper surface of the curved transition 128 may meet an upper surface of the base panel 102 substantially tangentially.

Figure 5:
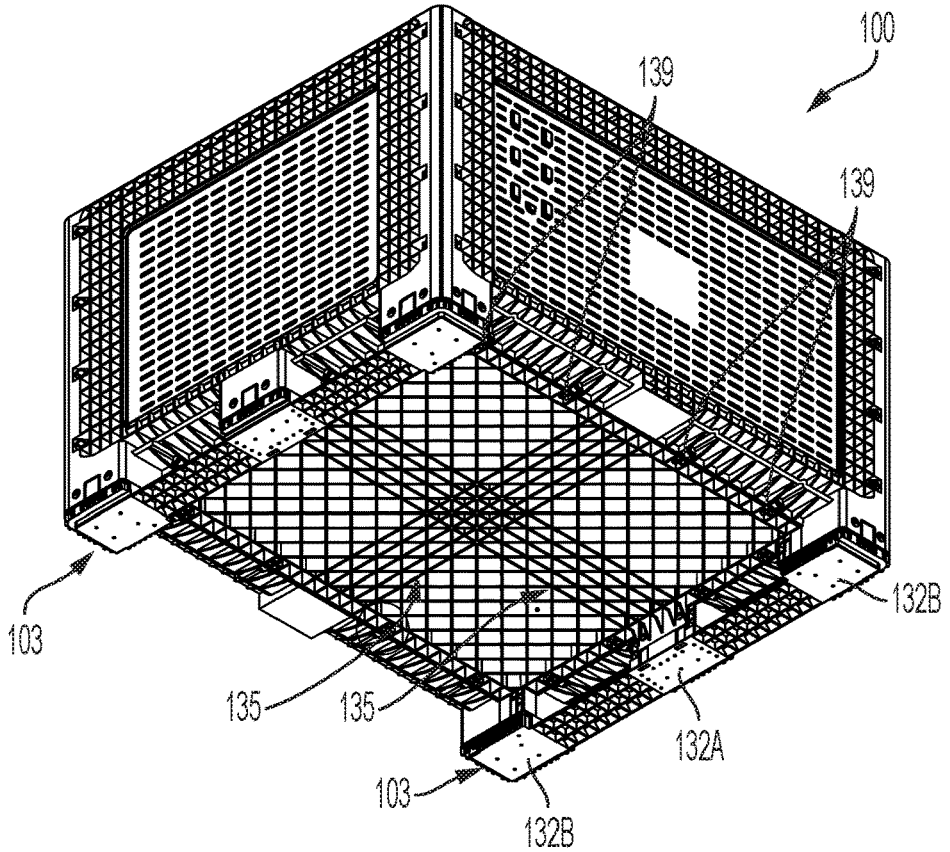
FIG. 5 shows an underside assembled perspective view of the crate.

FIG. 5 shows wherein the base panel 102 comprises an orthogonal arrangement of strengthening ribs 135.

Figure 17:
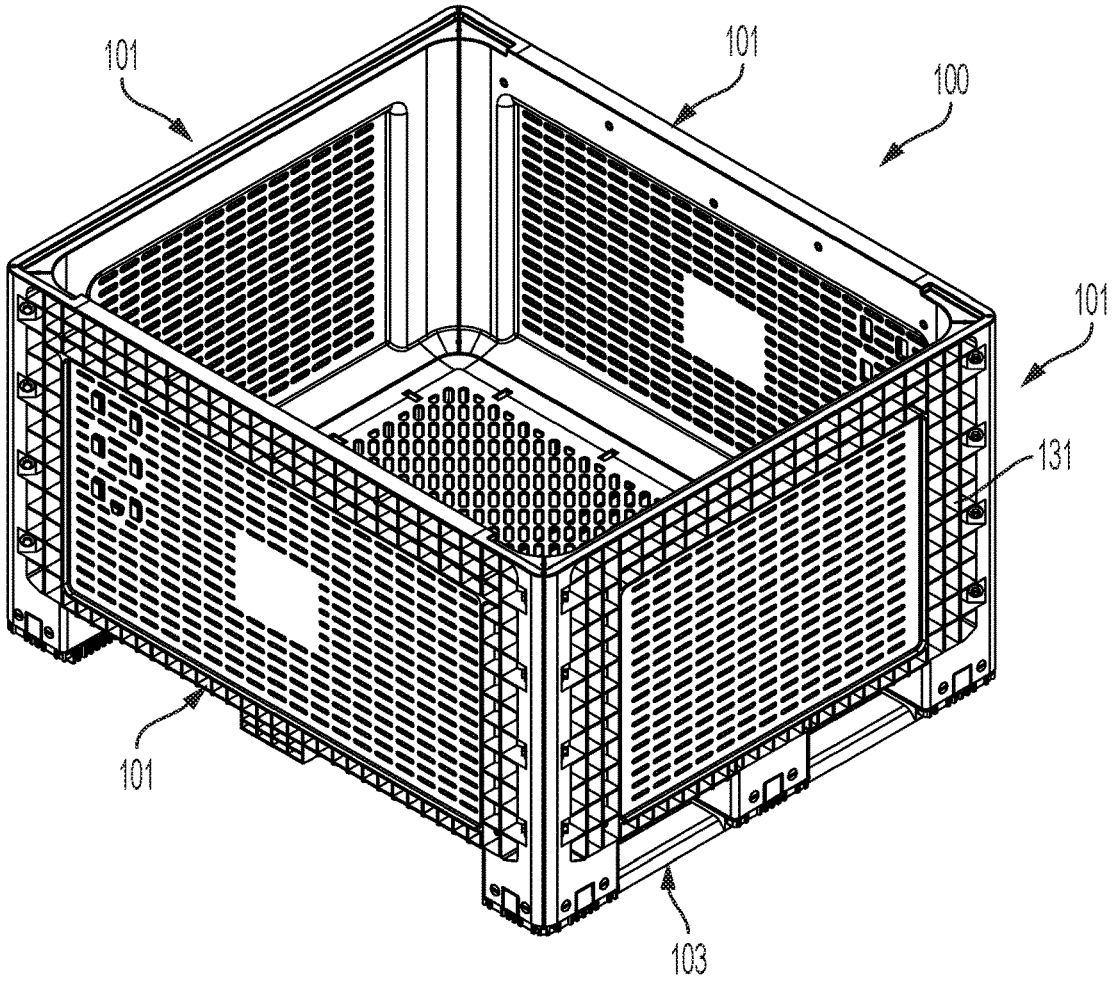
FIG. 17 shows a top perspective view of the crate in accordance with a further embodiment.

The side panels 101 and the base panel 102 may define a matrix of apertures 129 therethrough. One or more side panels 101 may comprise a central panel within the apertures 129 for labelling. The side panels 101 may be strengthened by peripheral latticework 131. FIG. 17 shows an embodiment wherein the peripheral latticework 131 is less dense than that shown in FIG. 1 to reduce the weight of the crate 100.

Each side panel 101 may further define a central side panel connector 113 which plugs into an upper central base connector 114.

Figure 7:
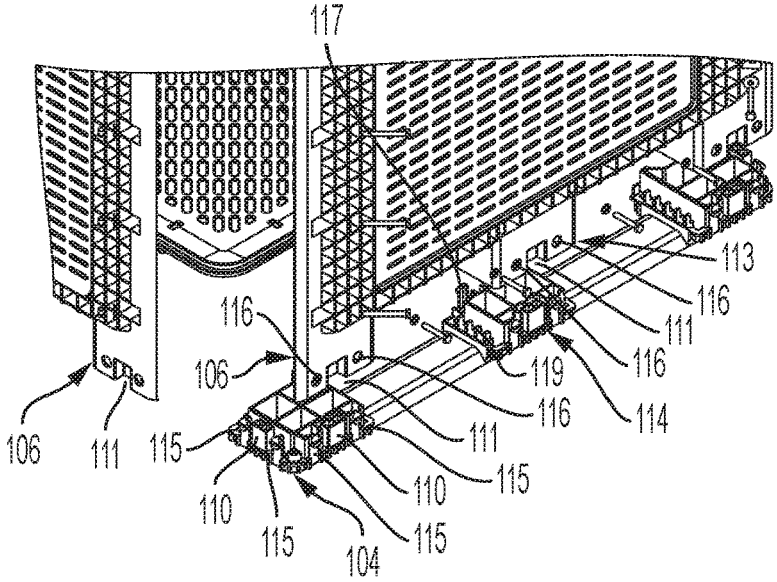
FIG. 7 shows a top perspective disassembled magnified view of the crate.
Figure 8:
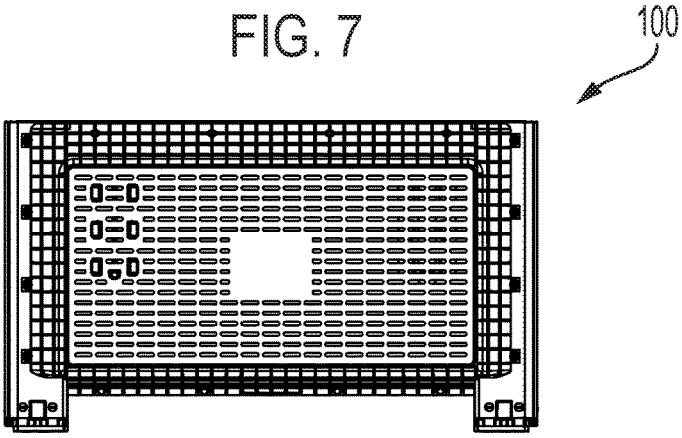
FIG. 8 shows a side elevation view of the crate; excellent
Figure 9:
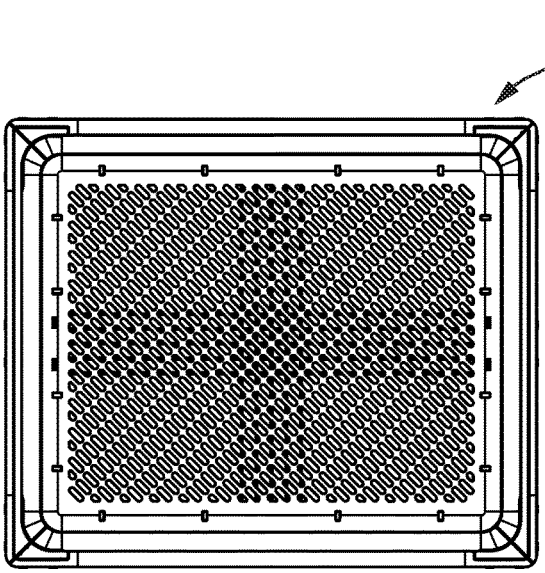
FIG. 9 shows a top plan view of the crate.
Figure 10:
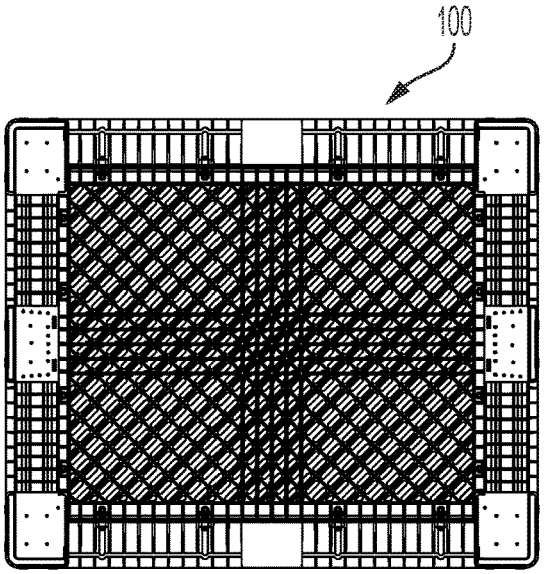
FIG. 10 shows an underside plan view of the crate.
Figure 11:
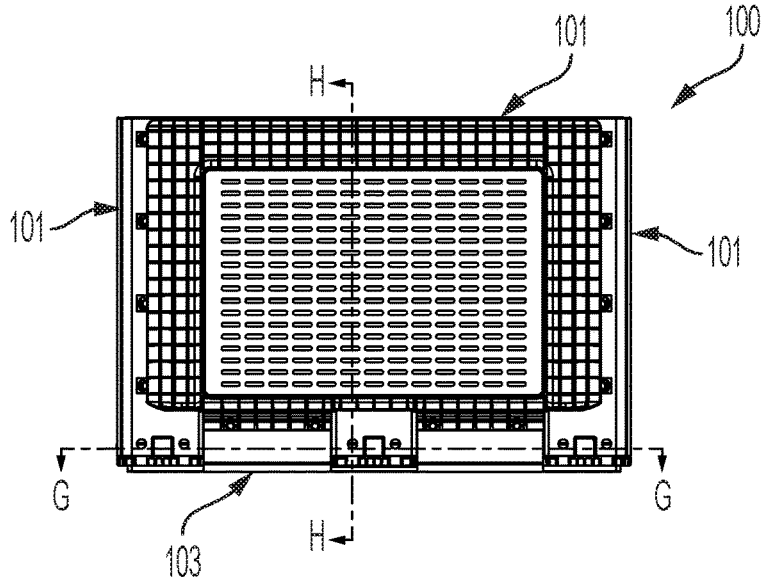
FIG. 11 shows an end elevation view of the crate.
Figure 12:
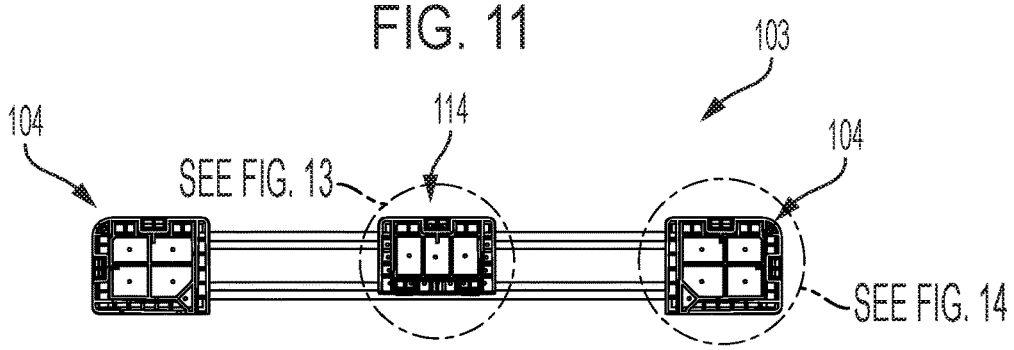
FIG. 12 shows a top plan cross-sectional view of the crate.

As is best shown in FIG. 7, each base connector 104, 114 may comprise a rectangular location tab 110 which locates in a corresponding slot 111 of a side panel connector 106, 113. The corner base connector 104 may comprise a pair of location tabs 110 arranged orthogonally.

Figure 13:
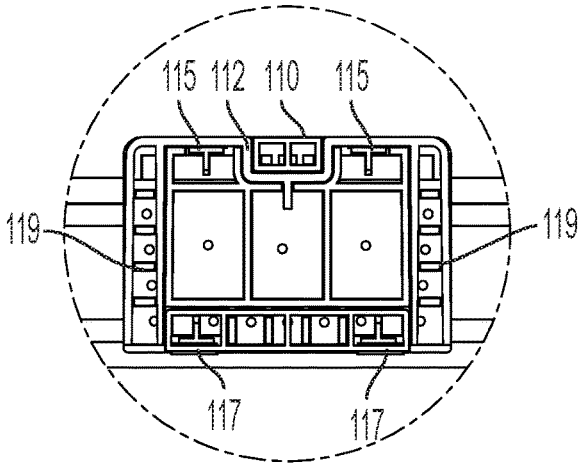
FIG. 13 shows a magnified top plan cross-sectional view of central side panel and base connectors in accordance with an embodiment.

As shown in FIG. 13, the rectangular location tab 110 may be located outwardly and the slot 111 may be defined by a peripheral edge 112 which goes behind the rectangular location tab 110 to prevent the side panel connector 106, 113 from moving outwardly.

As is further best shown in FIG. 7, the base connectors 104, 114 may further define deflecting clips 115 which engage corresponding apertures 116 of the panel connectors 106, 113. Each deflecting clip 115 may comprise a planar stem and a circular head having a chamfered upper edge which causes the head to deflect inwardly when the lower edge of the side panel connector 106, 113 is depressed downwardly thereon. Each base connector 104, 114 may comprise a pair of deflecting clips 115 either side of the location tab 110.

Figure 14:
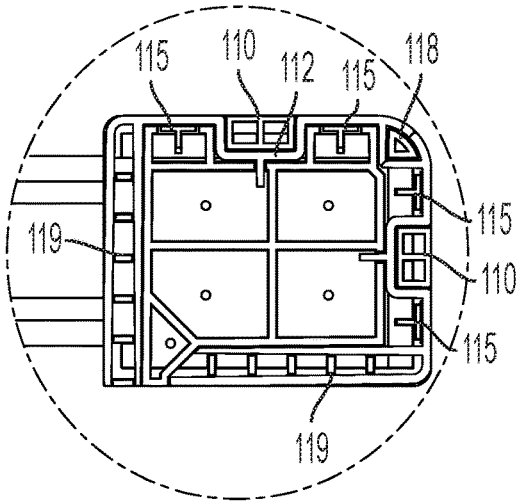
FIG. 14 shows a magnified top plan cross-sectional view of corner side panel and base connectors in accordance with an embodiment.
Figure 15:
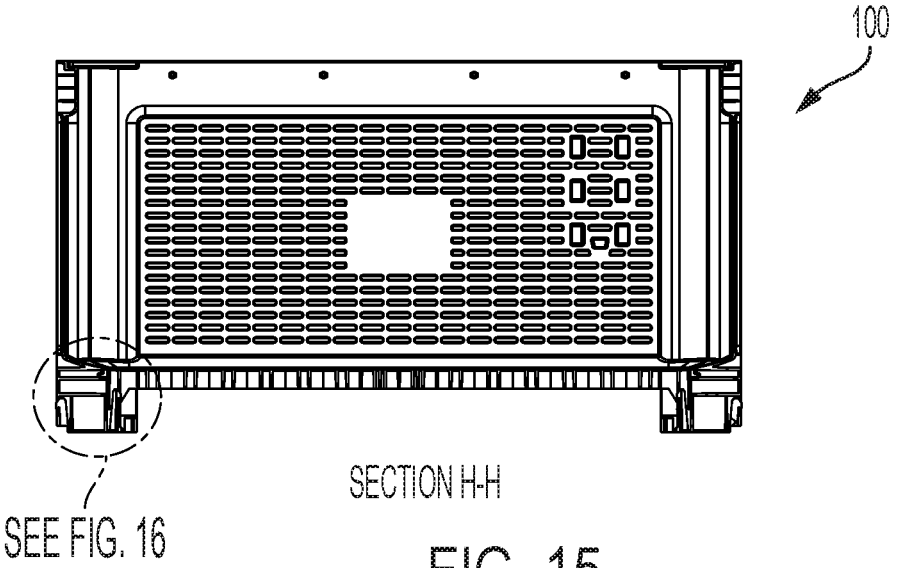
FIG. 15 shows a side elevation view of the crate.

As best shown in FIGS. 13 and 14, the deflecting clips 115 may be located and orientated outwardly. As best shown in FIG. 16, the central base connector 114 may further comprise inner deflecting clips 117 which go into corresponding apertures of the base panel 102. In this regard, the base panel 102 may comprise a base panel connector 145 defining an aperture 140 therein for the head of the inner deflecting clip 117. The inner deflecting clip 117 may be taller than the outer deflection clip 115.

As further shown in FIG. 16, the base panel 102 may define a peripheral edge 141 which rests atop a platform 142 defined by the skid 103 to support the weight thereof.

Furthermore, the base panel 102 may define an outer rail 143 which fits within a corresponding recess 144 of the side panel 101 under the transition 128. The outer rail 143 may define an undersurface which bears downwardly within the recess 144 to support the weight of the base panel 102 and furthermore may define an upper surface which may bear upwardly against an underside edge of the transition 128.

As best shown in FIG. 14, the base corner connectors 114 may comprise corner buttresses 118 which are enclosed by the interfacing edges 107 of the side panels 101.

Furthermore, sides of each base connector 104, 114 may comprise a series of buttress tabs 119 having an inner lower edge and an outer high edge thereby defining a channel which holds a corresponding edge of the panel connectors 106, 113.

Figure 6:
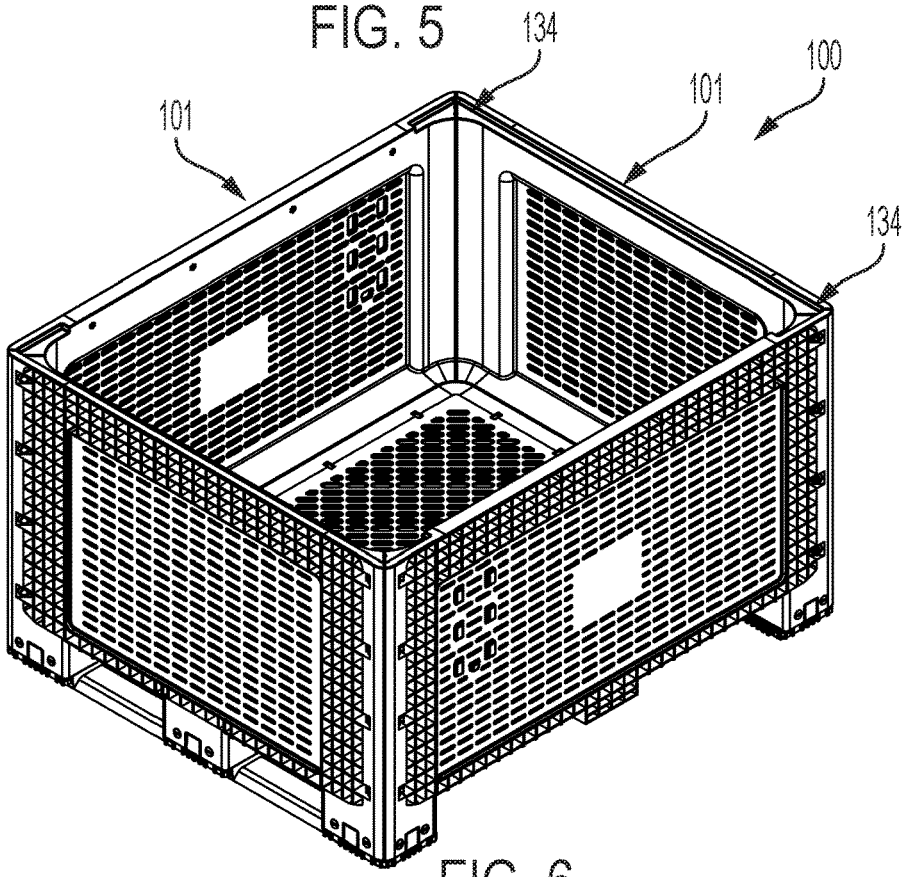
FIG. 6 shows a top perspective assembled view of the crate.

FIG. 5 shows wherein the skids 103 may define a central foot 132A and a pair of corner feet 132B. FIG. 16 shows wherein the planar undersurface feet 132 comprise an outer peripheral setback 133 for stacking of crates 100. FIG. 6 shows wherein corners of upper edges of the side panels 101 define shaped recesses 134 which seat the corner feet 132B therein.

Figure 18:
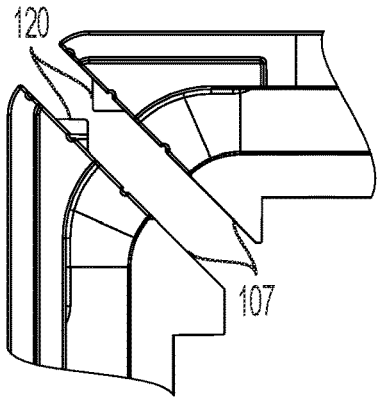
FIG. 18 shows a top plan view of interfacing edges of the crate of FIG. 17 in accordance with an embodiment.
Figure 19:
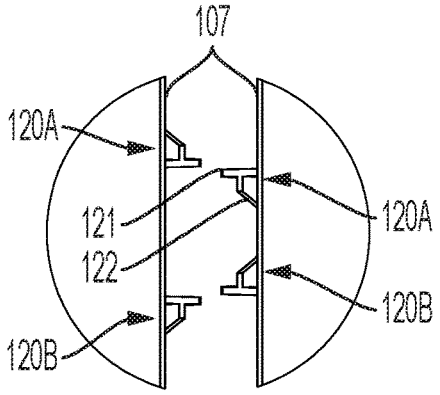
FIG. 19 shows a side elevation view of interfacing edges of the crate of FIG. 17 in accordance with an embodiment.
Figure 20:
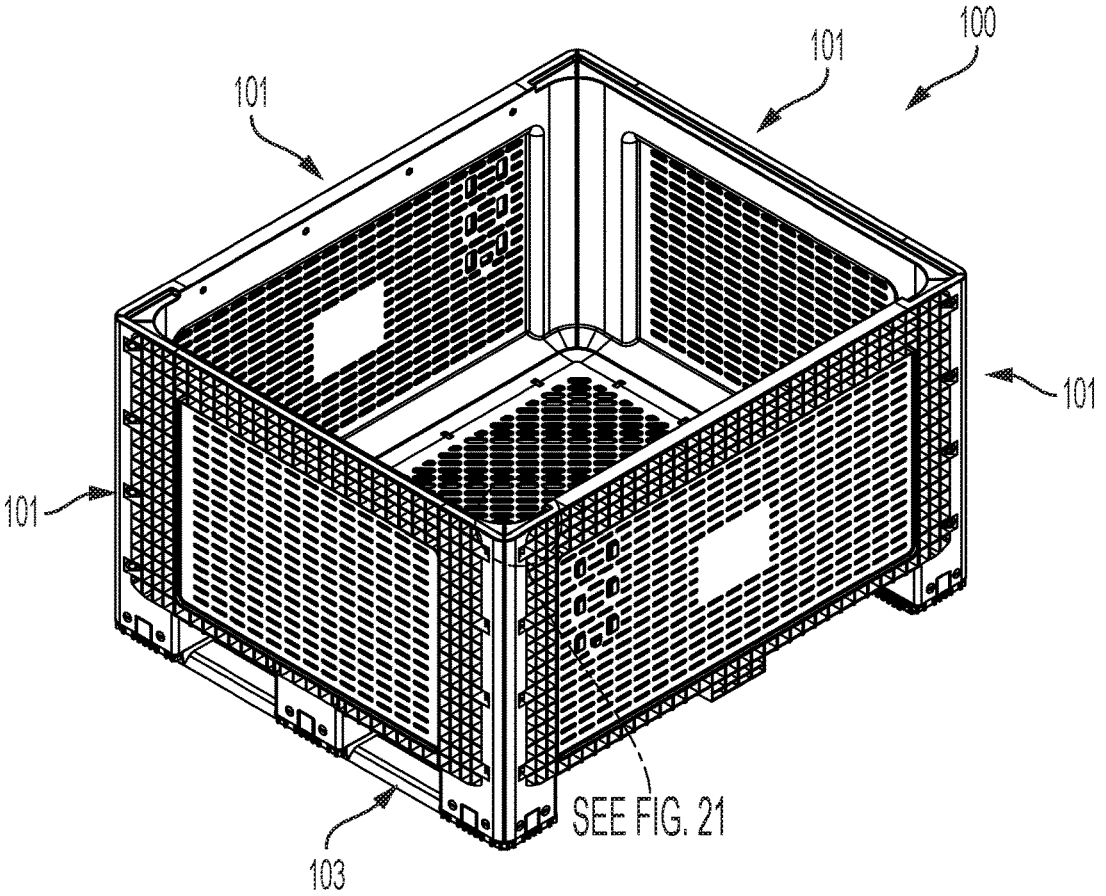
FIG. 20 shows a top perspective view of a crate in accordance with a further embodiment.

FIGS. 18 and 19 show wherein the interfacing edges 107 comprise vertical alignment locators 120 each having a platform 121 defining collocating planar faces to align the edges 107. Each platform 121 may be supported by an angled piece 122. Each edge 107 may comprise an upwardly orientated locator 120A and a downwardly orientated locator 120B. The locators 120 of one edge 107 may be configured to go between locators 120 of the other edge in the manner illustrated in FIG. 19.

Figure 21:
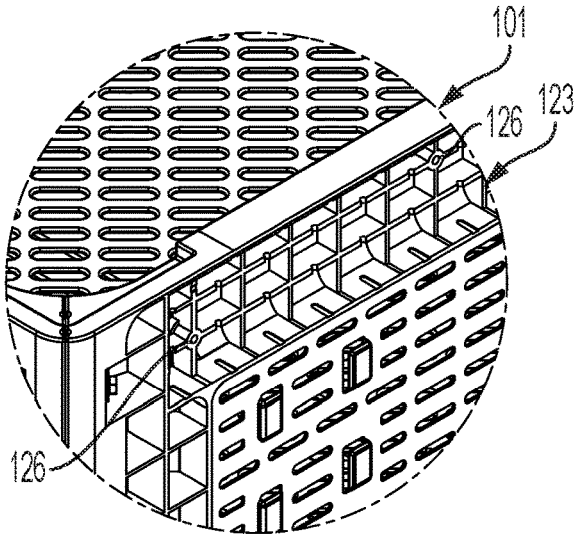
FIG. 21 shows a top perspective magnified view of the crate of FIG. 20.
Figure 22:
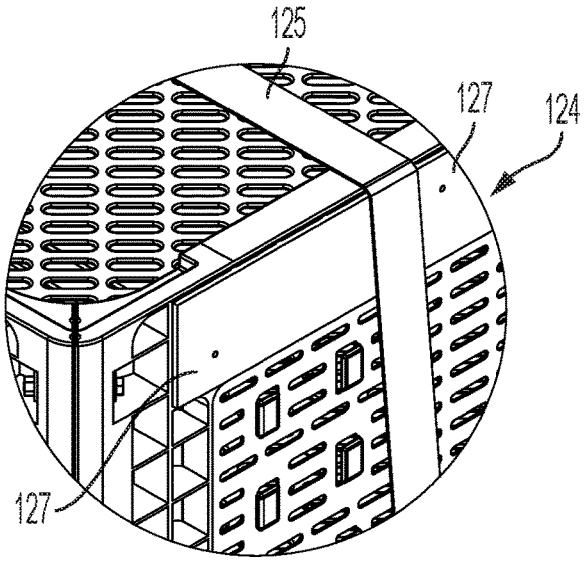
FIG. 22 shows a top perspective magnified view of the crate of FIG. 20.

FIG. 21 shows wherein upper edges of the side panels comprise longitudinal batten recesses 123 therealong within which a wooden batten 124 may be installed. The wooden batten 124 increases the rigidity of the upper edge to prevent flexing when the crate 100 is strapped with strapping 125.

The recess may comprise screw sockets 126 which engage screws going through corresponding apertures 127 of the wooden batten 124.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. A modular produce crate comprising four side panels, a base panel and a base having a quadrant of upper surface corner base connectors each defining a receptacle in an upper surface of the base, each side panel defining an interior base panel channel, a pair of side panel corner connectors extending below the channel and opposite side panel interfacing edges above the channel, wherein adjacent pairs side panel corner connectors plug downwardly into each respective receptacles of the corner base connector and clip into each respective corner base connector, wherein an edge of the base panel is engaged within the base panel channels to hold the base panel and adjacent interfacing edges thereof are fastened together, and wherein downwardly is defined as a direction toward a plane defined by a top surface of the base.

2. The crate as claimed in claim 1, wherein the base comprises a pair of elongate skids each having first and second ones of the upper surface corner base connectors at opposite ends thereof.

3. The crate as claimed in claim 1, wherein adjacent interfacing edges define collocating outer recesses defining inner parallel planar pieces secured together by a fastener extending therethrough.

4. The crate as claimed in claim 2, wherein additional fasteners secure lower edges of the side panels and the base panel.

5. The crate as claimed in claim 4, wherein the base panel is rectangular and wherein the additional fasteners run along long edges thereof.

6. The crate as claimed in claim 1, wherein each side panel defines an inwardly extending transition above and adjacent the channel which goes over a corresponding edge of the base panel.

7. The crate as claimed in claim 1, wherein the base panel comprises an orthogonal arrangement of strengthening ribs.

8. The crate as claimed in claim 1, wherein the side panels are strengthened by a peripheral latticework.

9. The crate as claimed in claim 1, wherein at least two side panels of the four side panels each include a central side panel connector which plugs downwardly into a central base connector formed in the upper surface of the base.

10. The crate as claimed in claim 9, wherein the base panel defines base panel connectors which plug into the central base connectors.

11. The crate as claimed in claim 1, wherein each corner base connector comprises a rectangular location tab which locates into a corresponding slot of a corresponding side panel connector.

12. The crate as claimed in claim 11, wherein each corner base connector comprises an orthogonal arrangement of a pair of location tabs.

13. The crate as claimed in claim 11, wherein the rectangular location tab is located outwardly and the slot is defined by a peripheral edge which goes behind the location tab.

14. The crate as claimed in claim 1, wherein each base connector comprises at least one deflecting clip which engages a corresponding at least one aperture of a corresponding side panel connector.

15. The crate as claimed in claim 14, wherein each deflecting clip comprises a stem and a head having a chamfered upper edge causing the head to deflect inwardly when a lower edge of a corresponding side panel connector is pressed down thereon.

16. The crate as claimed in claim 15, wherein each base connector comprises an outer rectangular location tab which locates into a corresponding slot of a corresponding side panel connector and wherein each base connector comprises a pair of deflecting clips either side of the location tab.

17. The crate as claimed in claim 14, wherein at least one base connector further comprises at least one deflecting clip which engages a corresponding at least one aperture of the base panel.

18. The crate as claimed in claim 1, wherein the base corner connectors comprise corner buttresses which are enclosed between the interfacing edges of the side panels.

19. The crate as claimed in claim 18, wherein each corner base connector comprises a series of side buttress tabs each having an inner lower edge and an outer high edge to thereby define a channel which holds a corresponding edge of a corresponding panel connector.

20. The crate as claimed in claim 1, wherein the base define corner feet each having an outer peripheral setback, and wherein upper edge corners of the side panels are shaped to define correspondingly shaped recesses to fit corner feet of another crate stacked thereabove.

21. The crate as claimed in claim 1, wherein the interfacing edges comprise vertical alignment locators defining planar faces which collocate to vertically align the edges.

22. The crate as claimed in claim 21, wherein each edge comprises an upwardly orientated planar face and a downwardly orientated planar face.

23. The crate as claimed in claim 1, wherein upper edges of at least two of the side panels comprises a respective batten recess therealong.

24. The crate as claimed in claim 23, wherein each recess comprises a plurality of screw sockets.

25. The crate as claimed in claim 23, further comprising wooden battens fitting within respective batten recess.

26. A method of assembling a crate as claimed in claim 1, the method comprising enclosing the base panel within adjacently collocating channels of the side panels arranged thereabout and pressing the side panels down onto the base to plug the side panel connectors into respective base connectors thereof.

27. The method as claimed in claim 26, further comprising fastening adjacent upper interfacing edges of the side panels.

* * * * *